United States Patent [19]

Ricci et al.

[11] 4,142,304

[45] Mar. 6, 1979

[54] APPARATUS FOR GAS TREATMENT OF ARTICLES TRAVERSING AN ENCLOSURE

[75] Inventors: Aldo Ricci, Treviglio; Nedo Passerini, Caravaggio, both of Italy

[73] Assignee: Saint-Gobain Industries, Neuilly-sur-Seine, France

[21] Appl. No.: 869,135

[22] Filed: Jan. 13, 1978

Related U.S. Application Data

[63] Continuation of Ser. No. 724,099, Sep. 17, 1976, abandoned.

[51] Int. Cl.[2] ..... F26B 25/02

[52] U.S. Cl. ..... 34/105; 34/203; 198/561; 198/728; 198/735; 432/124; 414/157

[58] Field of Search ..... 34/21, 236, 171, 174, 34/178, 104, 105, 165, 166, 168, 203; 198/603, 728, 373, 952, 561, 735; 214/1 P; 432/5, 6, 162, 123, 124, 129–131, 153, 154, 239, 243

[56] References Cited

U.S. PATENT DOCUMENTS

| | | | |
|---|---|---|---|
| 5,816 | 9/1849 | Scoville | 198/561 |
| 453,130 | 5/1891 | Ritscher | 198/561 |
| 903,620 | 11/1908 | Taliaferro | 34/105 |
| 1,065,448 | 6/1913 | Hollstein | 198/561 |
| 1,322,813 | 11/1919 | Parker | 34/105 |
| 2,087,731 | 7/1937 | Klouman | 432/124 |
| 2,313,814 | 3/1943 | Eisler | 198/728 |
| 2,418,683 | 4/1947 | Wilson | 34/203 |
| 2,717,548 | 9/1955 | Blair, Jr. | 198/728 |
| 3,111,452 | 11/1963 | Ewing et al. | 34/105 |
| 3,277,580 | 10/1966 | Tooby | 34/203 |
| 3,315,790 | 4/1967 | Hohl | 198/735 |
| 3,358,810 | 12/1967 | Zauner | 198/728 |
| 4,004,701 | 1/1977 | Moses | 214/1 PB |

*Primary Examiner*—Henry C. Yuen
*Attorney, Agent, or Firm*—John T. Synnestvedt; Kenneth P. Synnestvedt

[57] ABSTRACT

Treatment of articles in an enclosure traversed by gases, according to which the articles are advanced translationally and are simultaneously rotated, characterized by apparatus for causing the articles to travel the length of the enclosure several times and at different levels, and for causing the articles to roll on flat superimposed surfaces extending across the enclosure by bringing them in contact with driving components carried in a continuous or endless circuit so that the same components provide for successive travel of the articles first in one direction, and then in the other direction at two different levels.

4 Claims, 5 Drawing Figures

A
4
3

A
3
5
4

A
4
3

APPARATUS FOR GAS TREATMENT OF ARTICLES TRAVERSING AN ENCLOSURE

This is a continuation, of application Ser. No. 724,099, filed Sept. 17, 1976, now abandoned.

The present invention relates to a method and apparatus for the treatment of articles according to which an enclosure is traversed by gases whose temperature and/or composition are such thay they provide for treatment of the articles by contact with them.

The invention makes possible thorough and efficacious treatment of the articles while reducing the dimensions of the enclosure particularly in the direction of the path of movement of the articles as compared with prior arrangements.

The technique of the invention is of the type according to which the articles to be treated are advanced translationally and are simulatenously rotated, and is characterized in that the articles traverse the length of the enclosure several times and at different levels, and in that the articles are rolled on flat superimposed surfaces extending from one end of the enclosure by bringing them in contact with driving components carried in a continuous or endless circuit, so that the same components provide for successive travel of the articles first in one direction, and then in the other direction at two different levels.

The technique of the invention is particularly adapted to the treatment of articles in cylindrical spherical or oval form, the articles being rotated around their axes or centers, while being advanced translationally.

The technique according to the invention can be applied to diverse treatments such, for example, as for drying, curing and cooling operations, and heating operations, such as annealing, tempering or the like. It can likewise be used to provide for coating of the surfaces of the articles with materials such as glaze, paints, etc. whose composition may be heterogeneous and whose constituents are efficaciously mixed by the movements communicated to the articles. It can likewise be used to facilitate the application of semirigid, flexible or retractable coatings to the articles to be treated.

The articles to be treated can have a tubular form, particularly a cylindrical, tubular form. They can be made of various materials particularly of fibrous materials, especially fibrous insulating sleeves in which a curable binder is distributed between the fibers, the gases contained in the enclosure providing for thermal treatment throughout the entire thickness of the articles by effecting curing, polymerization or softening of the binder. The articles can, for example, be made up of fibrous insulating sleeves, particularly small diameter sleeves of the type referred to in the patent application of Bichot and Gest Ser. No. 578,087, filed May 16, 1975, and assigned to the assignee of the present application, relating to a method and apparatus for the continuous formation of insulating sleeves from fiber mat in which a binder is distributed, the sleeves having a porous structure but having layers at the internal and external surfaces, in which the resin is cured in order to stabilize the shape of the sleeves. Application Ser. No. 578,087 above referred to has been abandoned, and the subject matter thereof is presented in applications Ser. Nos. 761,564, filed Jan. 24, 1977 and 882,441, filed Mar. 1, 1978.

The invention concerns likewise an apparatus for use in carrying out the method described hereabove, the apparatus being made up of an enclosure comprising at least two superimposed, perforated decks on which the elements to be treated are rolled and at least one endless driven chain carrying driving elements in contact with the articles to be treated, the upper run of the endless chain providing for movement of the articles in one direction above on one perforated deck, while its lower run provides for their movement in the other direction over another perforated deck, the passage of the elements to be treated from one run to the other being accomplished by gravity.

Some other characteristics and advantages of the invention will be evident from the description which follows and which refers to a preferred embodiment of the apparatus. In the course of this description reference will be made to the attached drawings in which.

Figure 1:
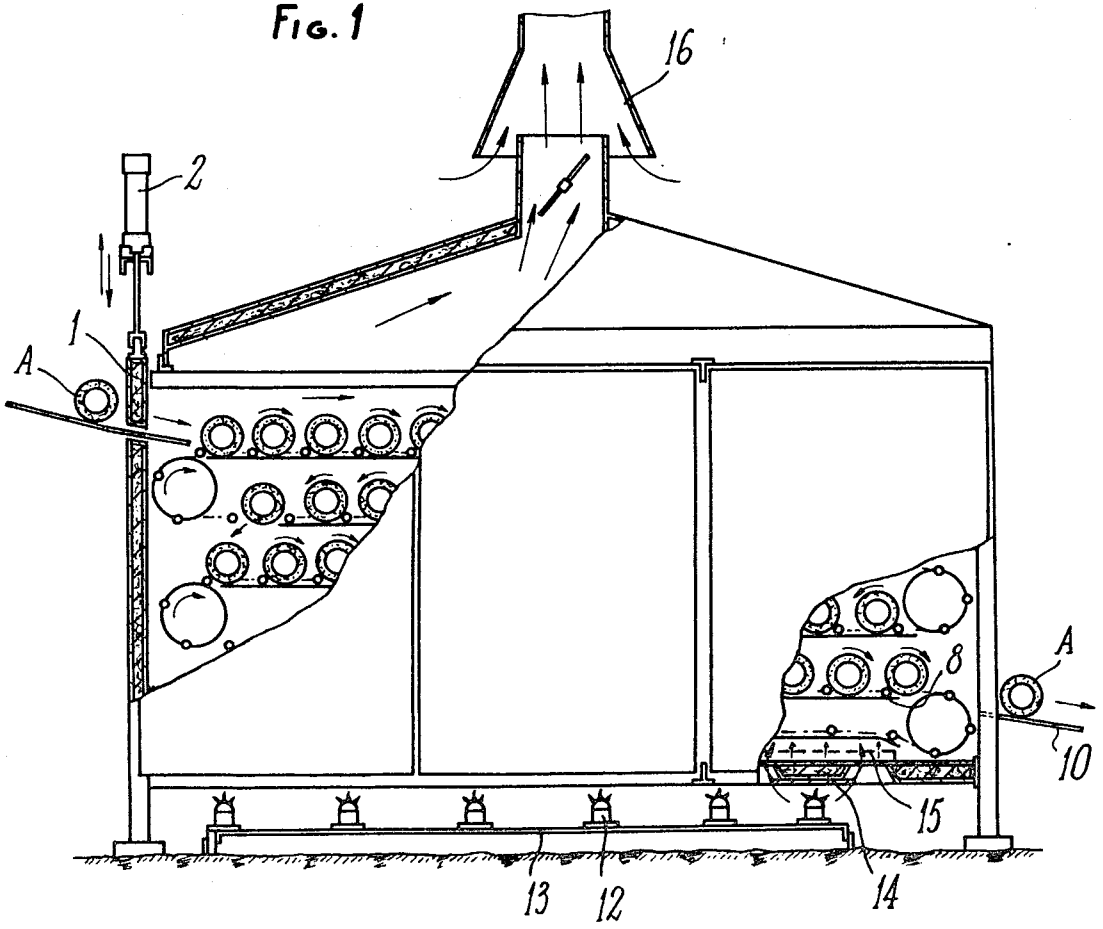
FIG. 1 is an elevational view with portions of the enclosure broken away.

The embodiment illustrated is arranged to provide for handling of fibrous insulating sleeves indicated by the letter A, the sleeves being formed from a fibrous mat in which a binder is distributed, as is more fully described in the patent application identified above. The equipment shown may be used to carry out the complete and uniform curing of the sleeves by providing for the polymerization or the hardening of the binder.

In the course of the curing in the enclosure or oven the sleeves are carried without constraint in such a way as to avoid unrolling the exterior layers of the fibrous mat, and therefore without formation of surface defects detrimental to both their structure and appearance. On the other hand, during the time the sleeves remain in the oven, the sleeves are supported on a flat surface throughout their length and the sleeves also rotate on their axes in such a manner as to promote uniform curing.

The sleeves A are successively brought to a door 1 on an inclined feed table, the door being activated by a jack 2 which stops each sleeve before its entry, thereby assuring that the sleeves will be delivered to the interior conveyor mechanism in the desired transverse position. The opening of this door is timed and limited in order to decrease the heat loss from the oven.

In order to lengthen the time the sleeves remain in the oven and to do so while limiting the length of the oven, the oven comprises several superimposed levels, of which there are five in the example illustrated.

Each of the levels is made up of a perforated plate or foraminous deck 3 which may desirably be formed of wire mesh, on which the sleeves A are rolled by being driven by means of small bars 4 carried by an endless carrier. The bars 4 should be spaced from each other a distance greater than the diameter of the articles. For the purpose of driving the bars, endless chains are provided, such as indicated at 5, with which the small bars are connected. Preferably a carrier chain is provided at each side of the decks. The arrangement according to the invention is such that one run of each endless chain 5 provides the movement of the sleeves in one direction and then, by its lower run provides for movement in the other direction in two successive stages on the perforated decks 3.

In the embodiment illustrated the three endless chains 5 are provided, and five superimposed runs are utilized for feeding the sleeves. The chains are preferably driven by a variable speed motor (not shown), for instance by connection with one of the chain carrying pinions 6 of each endless chain.

The sleeves A are successively placed on the perforated decks 3 between two successive bars 4. Each of the sleeves A is pushed by the bar situated immediately behind the sleeve, and the sleeve advances by rolling on the support deck 3. Between the end 9 of the perforated deck, the example of the top deck and the last bar 4, before the pinion 6, a free space is provided to allow the passage by gravity of a sleeve A to the next lower level. At this next level, the bars 4 move in the opposite direction since they are driven by the returning run of the endless chain. The result is that the sleeves are submitted, under the same conditions, to a new horizontal transfer in a direction opposite to that to which they were submitted at the level immediately above. The sleeves finally leave the lowermost deck 8 over the top of the adjacent pinion and are delivered to the inclined plane 10, for the final discharge from the equipment.

The heat for the oven is provided by a gas burners 12 placed on the floor 13 of the oven, and above the burners small insulating compartments 14 of non-oxidizing metal are provided to prevent localized overheating of the lower level of the oven. Homogenous distribution of hot air upward through the height of the oven is effected with the help of a thin perforated steel plate 15 parallel to and spaced the upper portions of the compartments 14, thereby distributing the hot air in the oven.

After coming in contact with all the sleeves, the air is ejected through the flue 16.

Figures 2, 4, 5:
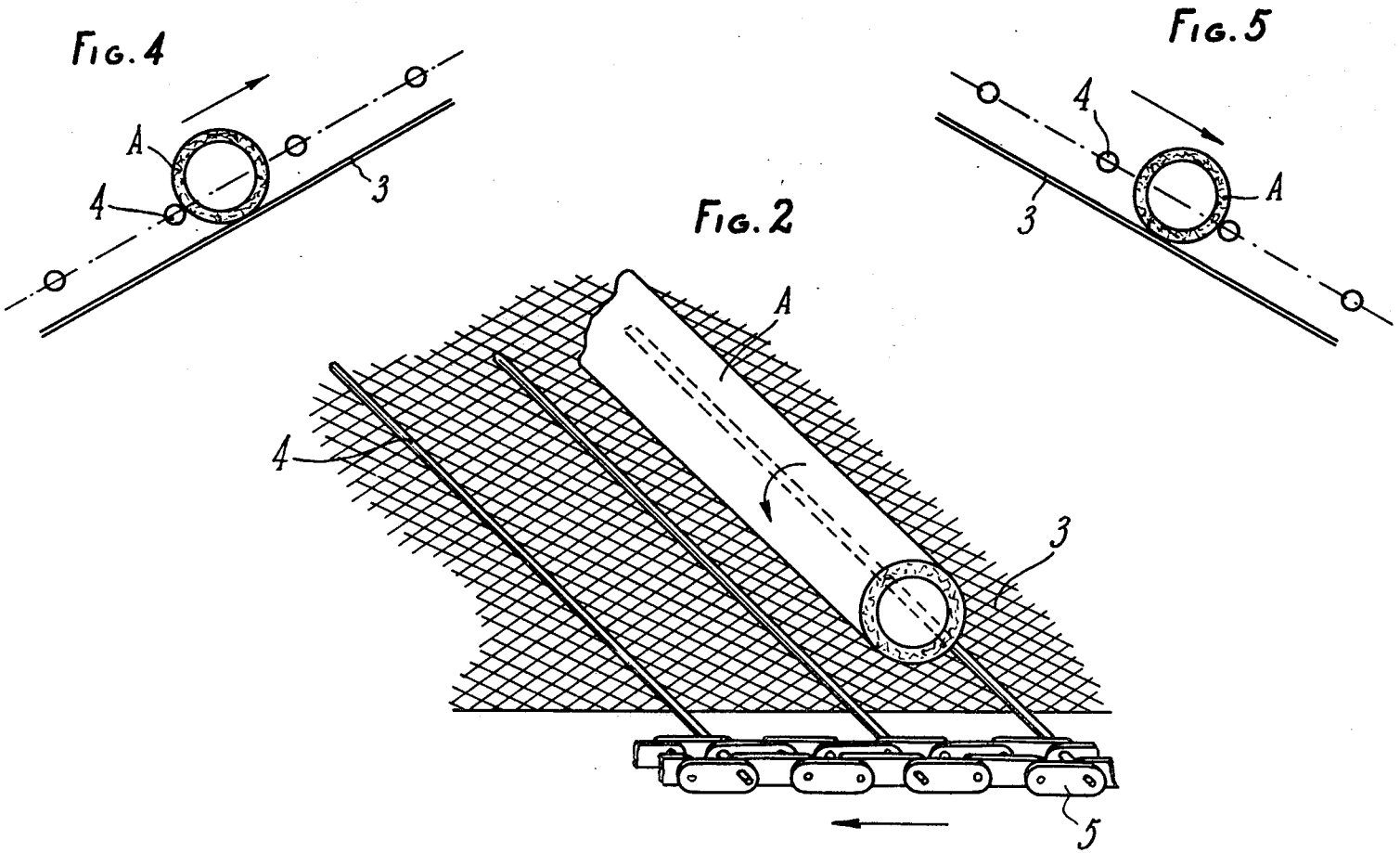
FIG. 2 is a fragmentary detailed perspective view showing the apparatus for driving and rotating the elements in the enclosure.
FIGS. 4 and 5 are diagrammatic fragmentary views of an alternative relative arrangements of components of the drive mechanism for articles to be treated.
Figure 3:
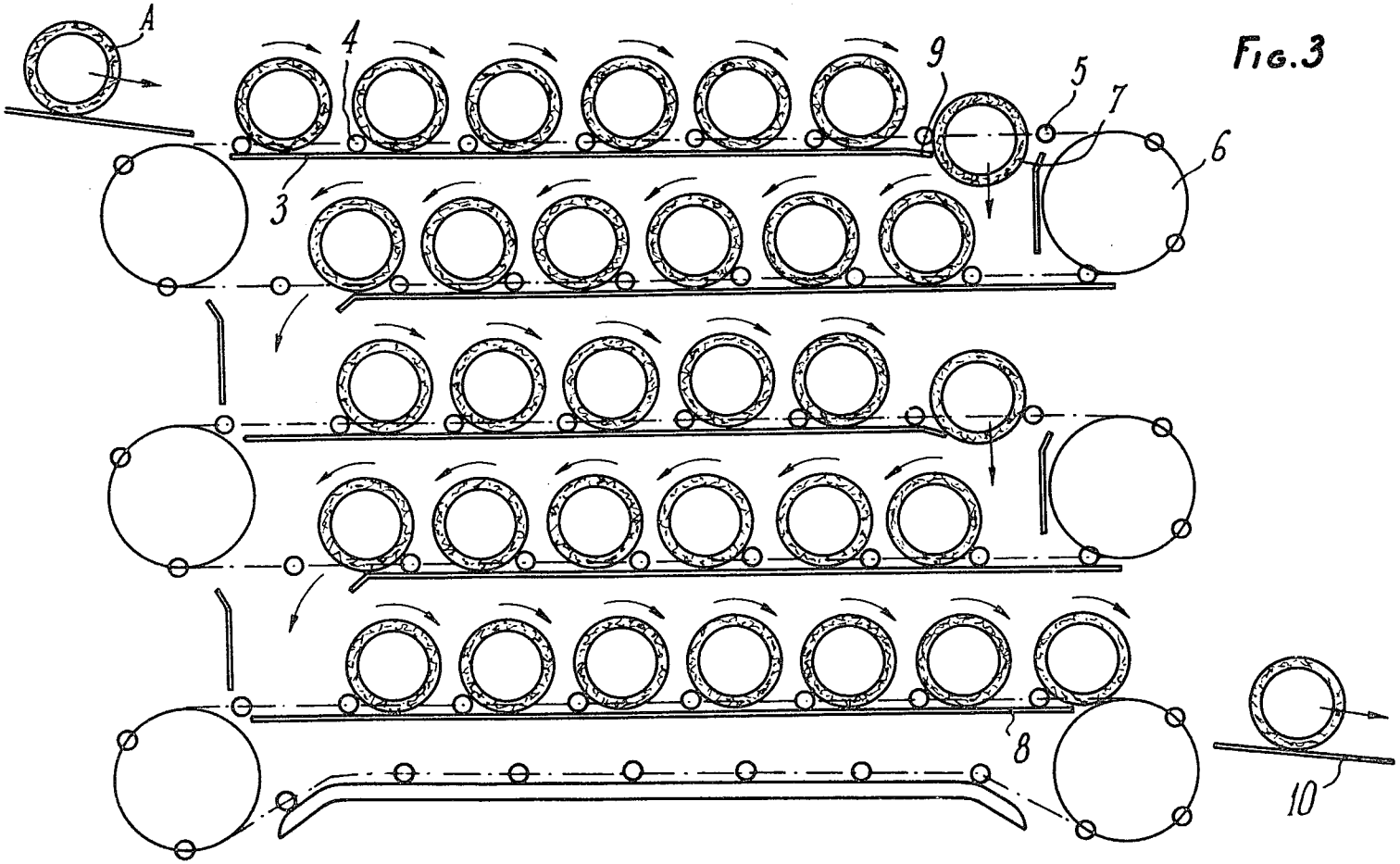
FIG. 3 is an enlarged longitudinal vertical section of the feeding mechanism in the enclosure of FIG. 1.

The embodiment described and illustrated in FIGS. 1, 2 and 3 incorporates decks 3 supporting the articles for travel in paths arranged horizontally.

FIGS. 4 and 5 illustrate fragmentarily and somewhat diagrammatically conditions which will prevail in cases where the decks 3 are obliquely inclined with respect to the horizontal. FIG. 4 illustrates a run of an endless conveyor for the driving elements 4 at an upwardly inclined angle, and showing a driving element in position behind a sleeve A, thereby driving the sleeve upwardly against the action of gravity. FIG. 5 illustrates a run of an endless conveyor for the driving elements 4 at a downwardly inclined angle, and showing a driving element in a position in advance of a sleeve A, thereby restraining and controlling the downward movement of the sleeve under the action of gravity.

When using inclined decks the driving elements 4 are desirably positioned at a greater spacing from the deck than is needed when using horizontal decks, and with runs which are inclined either upwardly or downwardly the arrangement assures uniform rotation of the articles being treated even when the articles are not precisely cylindrical or are intentionally manufactured with oval configuration.

The illustrations of FIGS. 4 and 5 may be considered as representing separate endless conveyors, but the conditions shown in FIGS. 4 and 5 may occur with a single endless conveyor where one run travels upwardly in one direction and the other run travels downwardly in the opposite direction.

The use of inclined decks, particularly downwardly inclined as represented in FIG. 5 is also of advantage in that it assists in discharging particles of matter such as fragments of fibers which have become detached from the articles being treated.

We claim:

1. Apparatus for use in heat treating cylindrical articles, comprising at least two superimposed but spaced foraminous decks, heating means for circulating a gaseous curing current through the decks, and mechanism for rolling a sequence of articles first in one direction on the surface of an upper deck and then in the opposite direction on a surface of a subjacent deck, said mechanism comprising a series of article engaging elements and an endless carrier for said elements, the carrier having a run travelling in said one direction over the surface of said one deck and the other run of said carrier travelling in the opposite direction over the surface of said subjacent deck, mounting mechanism for the carrier including a sprocket arranged at adjacent ends of superimposed runs of the carrier moving in opposite directions, the elements being mounted on the carrier with spacing greater than the diameter of the articles and in position to extend between the articles on the decks and thereby establish movement of the articles over the decks in spaced relation to each other and at a rate conforming with that of the endless carrier, said upper deck being terminated at its downstream end at a point spaced from the sprocket at the end of the cooperating run of the endless carrier to provide an opening larger than the diameter of the articles and located inboard of the sprocket for gravity delivery of articles from the upper deck to the subjacent deck.

2. Apparatus as defined in claim 1 in which the decks lie in substantially horizontal parallel planes, the article engaging elements serving to push the articles over the surfaces of the decks.

3. Apparatus as defined in claim 1 in which the decks lie in parallel planes obliquely inclined to the horizontal, the article engaging elements serving to push the articles over one deck inclined upwardly and serving to restrain the motion of the articles under the action of gravity as the articles advance downwardly over an adjacent deck.

4. Apparatus as defined in claim 1 in which the endless carrier comprises a pair of endless chains at opposite side edges of the decks and in which the driving elements comprise rods connected with the chains at spaced intervals.

* * * * *